United States Patent [19]

Jeffrey, III et al.

[11] Patent Number: 4,513,073

[45] Date of Patent: Apr. 23, 1985

[54] LAYERED PHOTOCONDUCTIVE ELEMENT

[75] Inventors: Frank R. Jeffrey, III; James R. Shirck, both of St. Paul, Minn.

[73] Assignee: Minnesota Mining and Manufacturing Company, St. Paul, Minn.

[21] Appl. No.: 524,525

[22] Filed: Aug. 18, 1983

[51] Int. Cl.[3] ..... G03G 5/082

[52] U.S. Cl. ..... 430/65

[58] Field of Search ..... 430/58, 63, 64, 65, 430/57

[56] References Cited

U.S. PATENT DOCUMENTS

| | | | |
|---|---|---|---|
| 4,217,148 | 8/1980 | Carlson | 136/89 SJ |
| 4,265,991 | 5/1981 | Hirai et al. | 430/64 |
| 4,297,392 | 10/1981 | Higashi et al. | 427/75 |
| 4,359,514 | 11/1982 | Shimizu et al. | 430/65 |
| 4,365,013 | 12/1982 | Ishioka et al. | 430/57 |
| 4,365,015 | 12/1982 | Katajima et al. | 430/62 |
| 4,377,628 | 3/1983 | Ishioka et al. | 430/57 |
| 4,378,417 | 3/1983 | Maruyama et al. | 430/84 X |

FOREIGN PATENT DOCUMENTS 2099600 12/1982 United Kingdom .

OTHER PUBLICATIONS

Shimizu et al., "Photoreceptor of a-Si:H with diodelike structure for electrophotography", *J. Appl. Phys.* 52(4) Apr. 1981, pp. 2776–2781.

Shimizu et al., "A Photoreceptor for Electrophotography Using an Amorphous Silicon Thin Film" *Photographic Science & Engineering,* vol. 24, No. 5, Sep./Oct., 1980, pp. 251–254.

*Primary Examiner*—John D. Welsh

*Attorney, Agent, or Firm*—John C. Barnes; Walter N. Kirn; Warren R. Bovee

[57] ABSTRACT

The present invention relates to a photoconductive element comprising a photoconductive layer and one or more blocking layers adjacent thereto and having space charge layers interposed between the photoconductive layer and the blocking layers to increase the voltage acceptance potential of the photoconductive element.

11 Claims, 4 Drawing Figures

LAYERED PHOTOCONDUCTIVE ELEMENT

FIELD OF THE INVENTION

The present invention relates to the field of electrography. More particularly, the present invention relates to the construction of photoconductive elements, including those employing amorphous silicon, and means to increase the acceptance potential of such photoconductive elements.

PRIOR ART

Various photoconductive materials are known and used in the field of electrophotography. For this application, the maximum electric field which can be sustained by a layer of such material is of great importance. This is due to the fact that the quality of the image that may be toned on an electrophotographic medium is related to the surface voltage which can be maintained by the photoreceptor. Since the acceptance potential is at least in part a function of thickness, the use of thick photoconductive layers is one means employed for achieving high acceptance potential. Where thin layers are desirable or required, for example to make a flexible, belt-type photoreceptor employing an inorganic photoconductor, the acceptance potential is relatively low.

Some photoconductive materials, particularly amorphous silicon hydrogen alloys (a-Si:H) are deposited by techniques that are slow compared to competing materials, e.g. selenium. Thus, because an adequate surface voltage is necessary to obtain quality images, it becomes economically important to provide a photoreceptor that can maintain useful surface voltages in a relatively thin layer.

Where amorphous silicon has been used as the photoconductive material, it has been found desirable to employ insulating blocking layers adjacent the photoconductive layer to decrease the dark current flow (dark decay) and thereby increase acceptance potential. The blocking layers of the prior art photoconductive elements, for example, as described in U.S. Pat. No. 4,265,991, are employed to prevent carrier injection into the photoconductive layer and generally comprise insulating materials such as oxides, selenides, sulfides and the like. Alternatively, doped silicon layers ave been employed as blocking layers to provide a diode structure having what is commonly known as a reverse biased p-n junction. These are described in, for example, Shimizu et al, *Journal of Applied Physics,* Vol. 52, pp. b 2776–2781.

Yet another photoreceptor construction described in U.K. patent application No. 2099600A describes an amorphous silicon photoconductive layer on a support with a double barrier layer interposed between the photoconductor and the support. The double barrier layer comprises an electrically insulating layer adjacent the photoconductive layer and a semiconductive, doped amorphous silicon layer adjacent the substrate. This construction is alleged to provide a photoconductive member having a number of improved performance characteristics.

The aforementioned methods provide voltage acceptance levels which are rather low for many applications.

SUMMARY OF THE INVENTION

The present invention provides means for overcoming the voltage acceptance level limitations inherent in known constructions employing photoconductive materials. More particularly, the present invention relates to means for increasing the sustained electric field within a photoconductive element so that it can maintain relatively high surface voltages. This is achieved in the present invention by providing a photoconductive element comprising an electrically conductive, supporting substrate with a photoconductive layer carried on the substrate and wherein a blocking layer means is carried adjacent to at least one major surface of the photoconductive layer to suppress the flow of charge carriers attracted toward the photoconductive layer as a result of surface charge applied to the element. The improvement of the present invention comprises the use of a space charge layer interposed between the blocking layer and the photoconductive layer. As used herein the term "space charge layer" refers to a semiconductive material which contains mobile charge carriers and embedded charge carriers of the opposite sign which, when subjected to an electric field, can be depleted of the mobile carriers leaving an embedded net charge of opposite sign in the layer. In the practice of the present invention, the space charge layers can comprise an n-type or p-type semiconductor material.

In the constructions described in the present invention the space charge layers are selected and located so that the effective electric field at the interface with the blocking layer is maintained at a level lower than the breakdown level of the blocking layer while the effective electric field at the photoconductor interface can be higher than the electric field at the interface with the blocking layer and can even exceed the breakdown level of the blocking layer. This allows charging the photoconductor to a level beyond that which would be permitted without the use of the space charge layers.

In order to accomplish the desired result, the space charge layers must be selected and located relative to the photoconductive layer such that the sign of the embedded charge in the space charge layer closest to the surface to which the charge is applied has the same sign as the sign of the applied charge. The space charge layer on the opposite side of the photoconductor must have an embedded charge of the opposite sign to the applied charge. This is true whether one or two layers is employed. Thus, the selection and location of the space charge layer is depending on the signal of the surface charge as will be explained in greater detail hereinafter.

In a preferred embodiment of the present invention a layer of photoconductive material, preferably a-Si:H, is interposed between two thin space-charge layers. These three layers are then together interposed between two insulating blocking layers thereby making up a five-layer construction which may be supported on a conductive substrate. Such a construction would typically be employed as the photoreceptor in drum or belt form in an electrophotographic copying process.

The use of space charge layers in the constructions of the present invention provide an increased acceptance potential for a given thickness of photoconductor by limiting the leakage current (dark current) through the blocking layer into the photoconductive layer. The increased acceptance potential occurs as a result of the inherent current flow limiting characteristics during charging of the construction described herein. For example, the acceptance potential of a photoreceptor construction employing a-Si:H photoconductor can be increased significantly for a given thickness. An increase of up to three times has already been demonstrated by the use of space charge layers as described herein.

The present invention allows the use of relatively thin photoconductor layers (about 0.5 to 5 micrometers) in applications requiring relatively high acceptance potentials. These thin layers exhibit increased resistance to peeling, cracking or fracturing when used in an endless belt system or the like. Additionally, manufacturing economies of significance are realized in that much reduced preparation time (deposition time) can be realized. Further, because the electric field present at the blocking layers is effectively reduced, as compared to prior art devices, the previously required stringent control over the compositional nature and thickness of the blocking layers, as used in the present invention, are minimized.

DETAILED DESCRIPTION OF THE INVENTION

Figure 1:
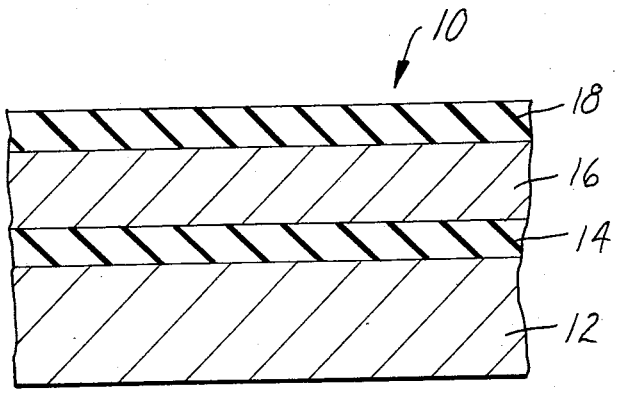
FIGS. 1 and 2 are schematic cross sections of photoconductor assemblies of the prior art and the present invention, respectively.

The photoconductor elements of the present invention can be exemplified by reference to the drawing wherein FIG. 1 shows, for purposes of comparison, a multilayer photoconductor assembly 10 according to the known prior art. The photoconductor assembly 10 comprises a supporting substrate 12 which carries a barrier layer or blocking layer 14 which is capable of preventing injection of electrical carriers from the substrate 12. A layer 16 of photoconductive material overlies the barrier layer 14 and a further covering layer 18 overlies the photoconductive layer 16. The layer 18 as shown may be a protective layer or may be a barrier or blocking layer similar to layer 14. For some applications layer 18 is not required and in other applications additional protective layers, release coatings and the like may be added to the construction shown in FIG. 1.

Figure 2:
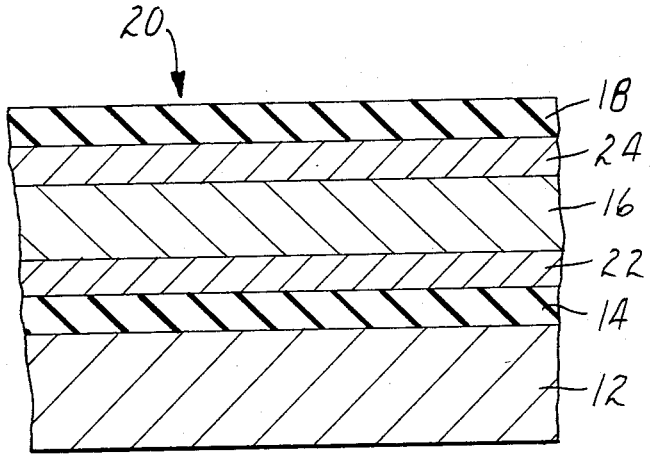

In contrast to the prior art constructions, an assembly according to the present invention is illustrated in FIG. 2 wherein the assembly shown generally at 20 comprises a substrate 12, barrier layers 14 and 18 and photoconductor layer 16 as in FIG. 1. However, adjacent both sides of photoconductor layer 16 there are provided space charge layers 22 and 24 which serve to increase the voltage acceptance potential of the assembly beyond that of the similar prior art assembly without such space charge layers as shown in FIG. 1 in the manner previously described. The substrate, barrier layer and photoconductive materials shown in FIGS. 1 and 2 are well known in the art. Typical substrates used to carry and support photoconductors for use in electrophotography are electrically conductive materials which may be flexible, as for use in a belt construction, or may be rigid to provide a plate or a drum. These substrates may be made of various metals such as aluminum, copper, chromium and the like and alloys thereof. A material which has been found useful in the practice of the present invention is stainless steel.

As used herein electrically conductive substrates are intended to include materials which are electrically insulating, but which carry or include a conductive material such that charge carriers may be transported to or from from the blocking layer 14 via the substrate 12. For example, the substrate may comprise an insulating layer such as polymeric or ceramic material to which has been applied an electrically conductive material such as by the electroless deposition, electrodeposition, e-beam deposition, vapor deposition, sputtering or the like of a metal or other conductive material.

The thickness of the supporting substrate may vary over a considerable range depending on the application and environment. For example, where flexibility is required as in the case of an endless belt, the substrate should be relatively thin. In the case of a stainless steel belt, 75 to 375 micrometers has been found suitable.

Layers 14 and 18 are insulating blocking layers which are employed to prevent or reduce dark decay of the charge applied to the photoconductive layer which can otherwise occur due to injection of charge carriers. A blocking layer 14, 18 for at least one sign of carrier should be effective between the photoconductive layer 16 and any source of carrier such as the substrate 12 and between the photoconductive layer 16 and any source of carrier on the side of the photoconductive layer opposite the substrate. Therefore, for positive charging at the surface of blocking layer 18 in FIGS. 1 and 2 blocking layer 14 must be chosen to provide a barrier for electrons while blocking layer 18 must provide a barrier for holes. For negative charging this will be reversed. The blocking must be effective at relatively high fields in order that developable surface charge be retained by the photoconductive assembly.

The use of insulating blocking layers 14 and 18 and the materials from which they are made are well known in the art. These layers may be insulating inorganic oxides such as $Al_2O_3$, SiO, $SiO_2$, $CeO_2$, $V_2O_3$, $Ta_2O$ and sulfides or selenides such as $As_2Se_3$, $Sb_2Se_3$ and $As_2S_3$ and the like, as well as insulating organic compounds such as polyethylene, polycarbonate, polyurethane, polyparaxylenes, and the like. Other materials such as silicon nitride may also be employed. These materials are described in U.S. Pat. Nos. 4,265,991, 4,377,628, 4,365,013, G.B. No. 2099600A and elsewhere.

In a preferred practice of the present invention, blocking layer 14 is a silicon:nitrogen:hydrogen alloy applied to substrate 12 using silicon or silane compounds, e.g., $SiH_4$, $SiH_3Br$, $SiH_3Cl$, $Si_2H_6$ and the like, along with hydrogen and nitrogen gasses. A variety of known deposition techniques can be used including glow discharge, ion plating, sputtering and the like, with reactive sputtering being a preferred process in the practice of the present invention. A preferred insulating, blocking layer 18 is a silicon suboxide $(SiO)_x$ where x is 2 or less and which may be prepared using fused silica or quartz in crystalline form. A preferred deposition process is that of electron beam evaporation.

The photoconductive layer 16 may comprise any photoconductive material of either the organic or inorganic type or mixtures thereof in either continuous film form or particulate binder form. Many such materials are known including materials such as Se, ZnO, CdS, $SnO_2$, $TiO_2$, polyvinylcarbazole, trinitrofluoroenone-polyvinylcarbazole and the like. Particularly useful materials are amorphous materials which comprise at least one of silicon or germanium atoms as a matrix and which contain at least one of hydrogen (H) or halogen (X) atoms. Such materials include hydrogenated amorphous silicon (a-Si:H), halogenated amorphous silicon (a-Si:X), hydrogenated amorphous germanium (a-Ge:H) and halogenated amorphous germanium (a-Ge:X) as well as corresponding silicon-germanium alloys of the above materials. Germanium may be useful in preparing materials that are sensitive to the near infrared region of the visible spectrum.

A material which has been found particularly useful in the practice of the present invention is hydrogenated amorphous silicon material (a-Si:H). This type of material is well known in the art and is described in several U.S. Pat. Nos. 4,377,628, 4,365,015, 4,365,013, 4,297,392, 4,265,991, etc. and elsewhere in the literature.

Hydrogen is present in this a-Si material as H bonded to Si or ionized and weakly bound to Si or as interstitial $H_2$. The hydrogen content may vary, as is known to those skilled in the art, between about 5 to about 40 atomic percent in order to obtain desired photoconductive properties. A preferred method of preparation is by RF glow discharge of silane, however, other techniques such as sputtering and chemical vapor deposition are well known and can also be employed to advantage.

Typical photoconductive elements made using a-Si:H will employ a photoconductive layer within the range of about 0.5 to about 50 micrometers with about 0.5 to about 5 micrometers being the preferred range. This thin layer resists cracking and peeling, a characteristic which is essential for use on flexible substrates. The preferred thickness may be different for other materials and applications. For example, organic photoconductors are generally more flexible than inorganic types and can generally be thicker and still retain sufficient flexibility for use in a flexible belt form. Generally it is desired to make the layer as thin as possible for reasons of flexibility and cost while still providing sufficient acceptance potential.

As noted hereinabove, the unique feature of the present invention is the use of one or more space charge layers 22, 24 disposed between the photoconductive element 16 and the blocking layers 14, 18 to enhance the acceptance potential of the photoconductive element beyond that obtainable by the use of blocking layers alone as described above.

The space charge layers 22, 24 of the present invention are comprised of n-type and p-type semiconductive materials. These are prepared by doping amorphous silicon in a manner well known in the art. A p-type layer may be prepared using a mixture of silicon compound such as $SiH_4$ or the like and a boron compound such as $B_2H_6$ or the like. A diluting gas such as argon may be used to introduce the silicon and boron compounds into a deposition chamber, with glow discharge deposition being a preferred preparation process. The amount of boron dopant is readily controlled by the relative ratio of the gaseous compounds present and is selected to provide the requisite electrical characteristics. The dopant quantity or amount is generally very low, that is, in the parts per million (ppm) range. When using boron as a dopant, typical B/Si ratios are in the range of about $10^{-6}$ to $10^{-2}$ and preferably in the range of $10^{-5}$ to $10^{-3}$. Materials other than boron are also suitable as dopants and include elements from Group III of the Periodic Table.

An n-type semiconductive space charge layer of doped silicon can be prepared using a mixture of a silicon compound such as $SiH_4$ or the like and a phosphorous compound such as $PH_3$ or the like. A diluting gas such as argon is also utilized to introduce the compounds into a deposition chamber. The amount of phosphorous dopant is readily controlled by the relative ratios of the gaseous compounds present and is selected to provide the requisite electrical characteristics. The dopant quantity or amount is generally very low, that is in the parts per million range. When using phosphorous as a dopant typical P/Si ratios are in the range of about $10^{-6}$ to $10^{-2}$ and more preferably $10^{-5}$ to $10^{-3}$. Materials other than phosphorous are suitable as dopants and include elements selected from Group V of the Periodic Table.

Figure 3:
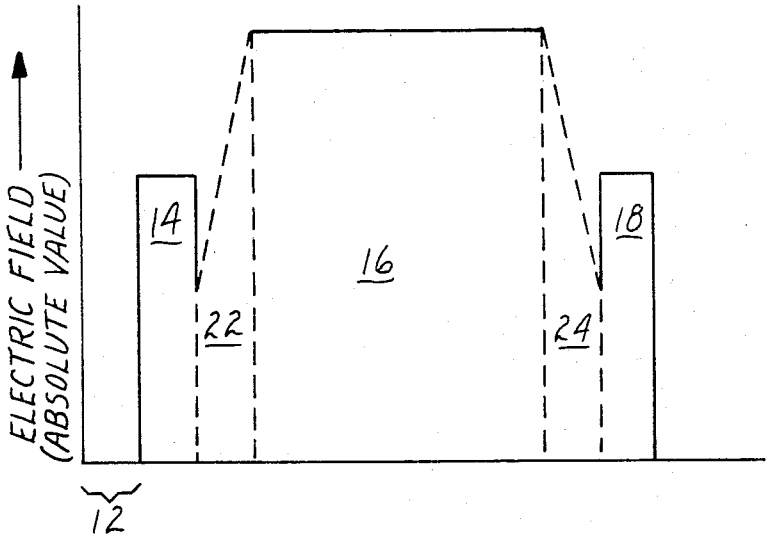

The multi-layer photoconductive element of the present invention may be used in an electrophotographic process as is well known in the art. For example, a positive or negative corona may be supplied to the surface of layer 18 of the photoconductive element shown in FIG. 2 via a high voltage power supply while keeping the element in a darkened state. Under these conditions the space charge layers 22 and 24 can maintain the electric field at the blocking layer 14, 18 interface at a level lower than that within the photoconductive layer 18. This effect is graphically shown in FIGS. 3 and 4 where a representation of the electric field in each of the blocking layers 14, 18 and photoconductive layer 16 is represented in arbitrary units, not to scale. As can be seen in FIG. 3, the construction of FIG. 2 employing the space charge layers 22, 24 of the present invention allows the presence of a higher electric field within photoconductive layer 16, and thus a higher surface voltage at surface 18, (the area under the "photoconductive layer" curve) than would be permitted with the use of the blocking layers alone. That is, the electric field of the photoconductive layer 16 exceeds the electric field breakdown level of the blocking layers 14, 18. In contrast, the element of the prior art as shown in FIG. 1 provides a much lower electric field and, thus, a lower surface charge, as shown graphically in FIG. 4. (As is well understood to those skilled in the art, the discontinuity in electric field strength shown at the interfaces with the blocking layers is the result of difference in electrical permitivity between the blocking layer material and the photoconductive material).

While not wishing to be bound by any particular theory, the present inventors believe that when the charging field is applied to the photoconductive element 20, the mobile carriers are swept clear of the n-type and p-type doped space charge layers leaving embedded charges behind and resulting in a negative space charge in the p-type layer and a positive space charge in the n-type layer. These space charge layers 22, 24 then provide an electric field at the interface with the photoconductive layer 16 which is greater than that present at their interface with the blocking layers 14 and 18. These space charge "buffer" layers 22, 24 allow the presence of a higher electric field in the photoconductive layer than the blocking layers 14, 18 alone can withstand.

Thus, the present invention provides photoconductive elements wherein the acceptance voltages are controlled by the electric field breakdown in the specific photoconductive layer rather than being controlled by the properties of the blocking layer.

In addition to the five-layered structure shown in FIG. 2, constructions having fewer than five layers may also be useful in certain applications. For example, structures comprising layers 12, 14, 22 and 16 or, alternatively, layers 12, 16, 24 and 18 may be useful due to the nature of the charge carrying characteristics of the photoconductor. Thus, because some organic photoconductive materials, such as polyvinylcarbazole, carry out one sign of charge it is only needed to prevent the flow of charge carriers in one direction. Further, blocking and space charge layers would not be needed at interfaces or surfaces where charge injection does not inherently occur.

The present invention can be further illustrated by reference to the following examples.

EXAMPLE 1

A photoconductive element similar to that shown in FIG. 2 was prepared as follows:

A stainless steel substrate was cleaned by treatment with a series of common organic solvents and subsequently washed with distilled water and dried with a jet of nitrogen. A portion of the substrate which was 0.07 mm in thickness and 5 cm×5 cm on a side was placed in a fixed position in the deposition chamber of an RF diode sputtering apparatus.

The silicon:nitrogen:hydrogen blocking layer was deposited by reactive sputtering using a pure Si target in an atmosphere of nitrogen and hydrogen. A partial pressure of about 5 mTorr of nitrogen and about 1 mTorr of oxygen was maintained. About 500 watts of RF power was applied to a target having a diameter of about 20 cm thereby developing a target voltage of about 1300 volts. A bias voltage of about 25 volts was applied to the stainless steel substrate. A deposition rate of about 2 Å per sec was achieved such as to deposit a blocking layer of silicon:nitrogen:hydrogen to a thickness of about 0.05 micrometers.

A p-type semiconductive space charge layer was then deposited over the silicon:nitrogen:hydrogen blocking layer by a glow discharge process utilizing a capacitively coupled RF flow discharge having 23 cm diameter electrodes. A mixture of silane ($SiH_4$), diborane ($B_2H_6$) and argon, as a diluting gas, was introduced into the deposition chamber. The ratio of $SiH_4$ to argon was about 1 part by weight of $SiH_4$ to 9 parts by weight of argon. The volume concentration of $B_2H_6$ was about 550 parts per million (ppm) with respect to the $SiH_4$ content. A system background operating pressure of about 0.1 Torr was maintained while the aforementioned gasses were introduced at a total mass flow rate of about 30 standard cubic centimeters per second. The substrate was maintained at a temperature of about 250° C. A deposition rate of about 1 Å/sec was achieved at a RF power level of about 10 W to deposit a space charge layer of boron doped amphorous Si to a thickness of about 0.27 micrometers.

An undoped photoconductive a-Si:H layer was then deposited over the boron doped a-Si layer utilizing the same deposition system and conditions as described for the boron doped a-Si layer, with the exception of eliminating $B_2H_6$ from the gas mixture. The a-Si:H layer was deposited to a thickness of about 0.9 micrometers.

An n-type semiconductive space charge layer was next deposited over the photoconductive a-Si:H layer again utilizing the deposition system and conditions as utilized for generating the p-type semiconductive space charge layer. Phosphorous was incorporated in the gas mixture by substituting $PH_3$ for $B_2H_6$ used in generating the p-type layer. The volume concentration of $PH_3$ was about 800 ppm with respect to the $SiH_4$ content. The n-type semiconductive space charge layer was deposited to a thickness of about 0.2 micrometers.

Subsequently, a silicon suboxide $SiO_x$ blocking layer was deposited over the n-type semiconductive space charge layer. A Balzers (Model #710) evaporation system equipped witn an e-beam source was used to deposit the $SiO_x$ layer while operating at a background pressure of about $2\times10^{-6}$ Torr with a crystalline quartz target. A deposition rate of about 5 Å/sec was achieved to generate a $SiO_x$ layer of about 0.09 micrometers thickness.

The photoconductive assembly was charged for 3 seconds with a Corona of 8.5 kv potential. Three seconds after charging the surface voltage of the assembly was at 47 volts. FIG. 3 illustrates the expected electric field distribution obtained with this sample. In FIG. 3 the areas of the graph identified by reference numerals 12, 14, 16, 18, 22 and 24 represent the electric field in the corresponding layers of the photoconductive element shown in FIG. 2. The assembly could be discharged with a light source and was found to have characteristics rendering it useful as a photoreceptor element for use in electrophotography.

EXAMPLE 2

A photoconductive element of the prior art as illustrated in FIG. 1 was prepared as in Example 1 but with the exception that the p-type and n-type semiconductive space charge layers 22, 24 of FIG. 2 were eliminated.

Figure 4:
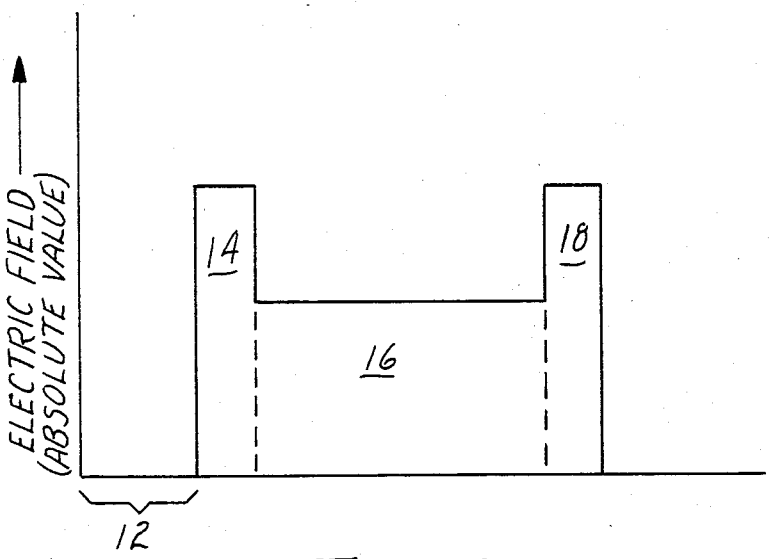
FIGS. 3 and 4 are graphs showing the electric field distribution comparison between a photoconductor assembly including space charge layers according to the invention and an assembly excluding such space charge layers.

When charged as in Example 1 a surface voltage of only 17 volts was measured 3 seconds after charging. FIG. 4 illustrates the expected electric field distribution obtained with this sample.

What is claimed is:

1. In a photoconductive element comprising an electrically conductive, supporting substrate and a photoconductive layer carried by said substrate wherein a blocking layer means is carried adjacent at least one major surface of said photoconductor layer to suppress the flow of charge carriers attracted toward the photoconductive layer as a result of any surface charge applied to said element, wherein the improvement comprises a space charge layer interposed between said blocking layer means and said photoconductive layer, said space charge layer comprising a semiconductive material selected from the group consisting of n-type and p-type semiconductor materials, the space charge layer between said photoconductive layer and said blocking layer being selected so that upon charging said photoconductive element the electrical field at the interface between said space charge layer and said photoconductor is higher than the electric field at the interface between said space charge layer and said blocking layer.

2. A photoconductive element according to claim 1 wherein said photoconductive element contains two blocking layers with one layer adjacent each major surface of said photoconductive layer and wherein space charge layers are interposed between said photoconductive layer and said blocking layers.

3. A photoconductive element according to claim 1 wherein said semiconductive material is a material having an atomic matrix selected from the group consisting of silicon and germanium atoms and which contains at least one of hydrogen or halogen atoms.

4. A photoconductive element according to claim 3 wherein said semiconductive material is doped with materials selected from the group consisting of the elements of Group III and Group V of the periodic table.

5. A photoconductive element according to claim 4 wherein said n-type space charge layer is a phosphorous-doped amorphous silicon:hydrogen alloy.

6. A photoconductive element according to claim 4 wherein said p-type space charge layer is a boron-doped amorphous silicon:hydrogen alloy.

7. A photoconductive element according to claim 1 wherein said photoconductive layer is selected from the group consisting of organic photoconductor and inorganic photoconductor and mixtures thereof.

8. A photoconductive element according to claim 7 wherein said photoconductive layer comprises hydrogenated amorphous silicon.

9. A photoconductive element according to claim 8 wherein said photoconductive layer has a thickness of about 0.5 to about 5 micrometers.

10. A photoconductive element according to claim 1 wherein said element is a continuous, flexible belt.

11. An electrographic apparatus containing a photoconductive element according to claim 1.

* * * * *